United States Patent [19]

Harrison

[11] 4,411,389

[45] Oct. 25, 1983

[54] FILLER GUN SUITABLE FOR CAVITY INJECTION

[75] Inventor: John D. Harrison, Newbury, England

[73] Assignee: Shell Internationale Research Maatscappij, B. A., Netherlands

[21] Appl. No.: 325,181

[22] Filed: Nov. 27, 1981

[30] Foreign Application Priority Data

Dec. 2, 1980 [GB] United Kingdom ..... 8038646

[51] Int. Cl.[3] ..... B05B 7/00

[52] U.S. Cl. ..... 239/427.5; 239/428; 239/430; 239/600; 222/145; 406/153

[58] Field of Search ..... 222/145, 129, 129.2, 222/630; 406/47, 48, 153, 194, 144; 239/428, 430, 427.5, 600; 285/354, DIG. 1

[56] References Cited

U.S. PATENT DOCUMENTS

| | | | |
|---|---|---|---|
| 2,503,743 | 1/1948 | Keefer | 239/428 |
| 2,671,692 | 3/1954 | Matirko | 299/140 |
| 3,795,348 | 3/1974 | Vertue | 222/193 |
| 3,799,438 | 12/1972 | Shockley | 239/8 |

FOREIGN PATENT DOCUMENTS

| | | |
|---|---|---|
| 1036497 | 8/1958 | Fed. Rep. of Germany . |
| 2641195 | 3/1978 | Fed. Rep. of Germany . |
| 818377 | 9/1937 | France . |
| 849019 | 9/1960 | United Kingdom . |
| 1158210 | 7/1969 | United Kingdom . |
| 1600096 | 10/1981 | United Kingdom . |

*Primary Examiner*—Joseph J. Rolla
*Assistant Examiner*—Patricia Kridler
*Attorney, Agent, or Firm*—Pravel, Gambrell, Hewitt, Kirk & Kimball

[57] ABSTRACT

The invention provides a filler gun suitable for injecting a mixture of particulate solid and liquid binder into a cavity, for example the wall cavity of a building, which comprises a hollow body having an outlet at one end, a binder inlet for liquid binder at the other end, and a side inlet for granular or particulate solid, which side inlet is directed towards the outlet at an angle of less than 90° with respect to the direction of flow of liquid binder from the binder inlet to the outlet in operation of the gun, wherein an outlet sleeve is releasably located in the body between the side inlet and the one end and an inlet sleeve is releasably located in the body between the side inlet and the other end, the inlet sleeve having an axial bore and a side passage opening into the bore which passage is adapted for the reception of a liquid binder supply line, and the body is slotted to enable withdrawal of the inlet sleeve therefrom without prior detachment of the supply line.

7 Claims, 1 Drawing Figure

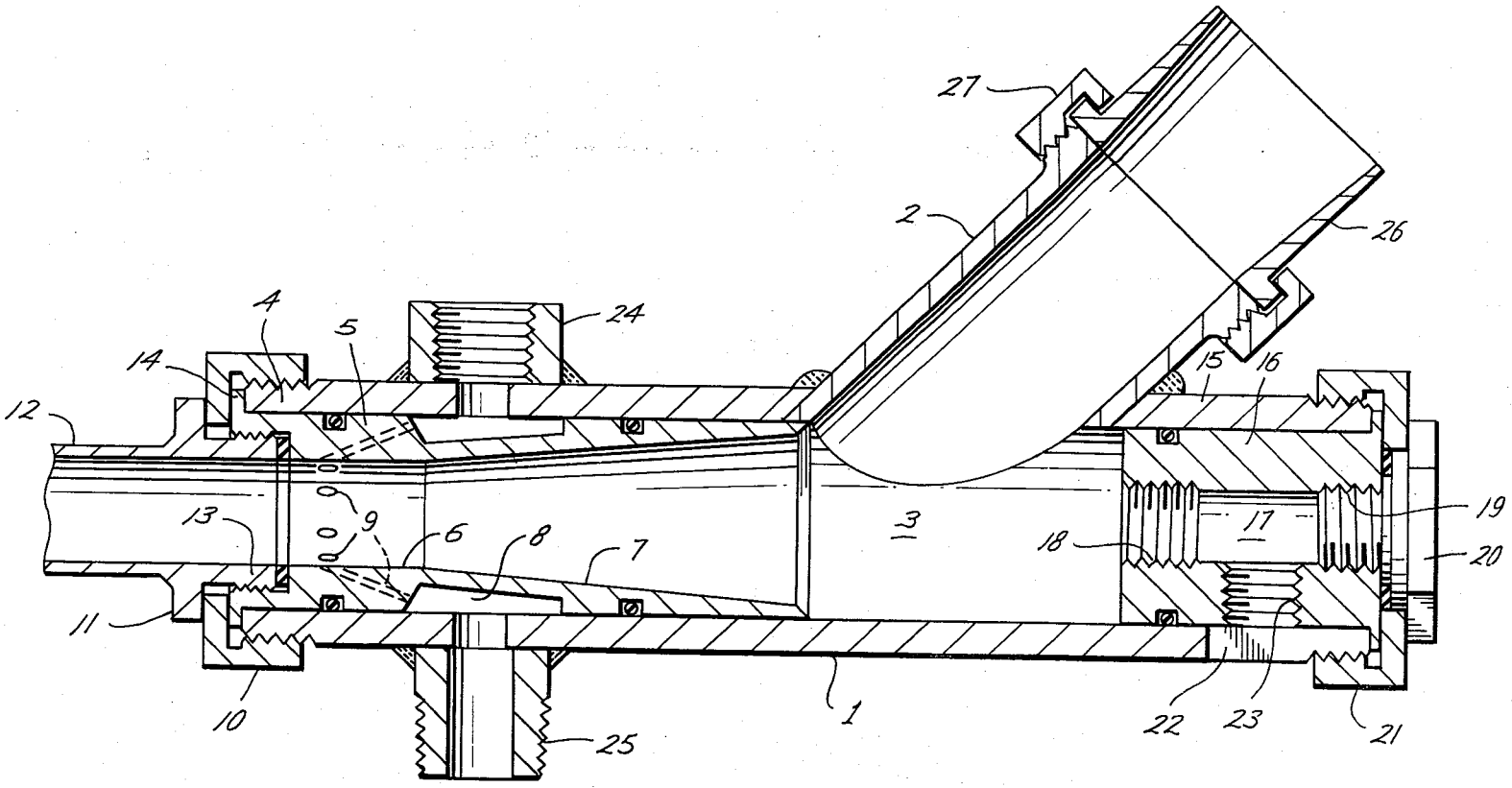
19
20
21
26
16
17
23
15
22
18
27
2
3
1
24
7
25
8
6
5
9
4
10
13
14
11
12

FILLER GUN SUITABLE FOR CAVITY INJECTION

The present invention relates to a filler gun suitable for injecting a mixture of a granular or particulate solid and a liquid binder into a cavity, for example in providing cavity insulation between two walls.

Buildings having cavity walls can be thermally insulated by introducing thermal insulation into the cavity between the walls. One type of thermal insulation comprises granular material bound into a cohesive mass with a binder. To form such insulation within a cavity a mixture of the granular solid and a liquid binder is formed in a filler gun and then immediately introduced into the cavity. The flow properties of the mixture are such that the mixture can move freely, and the cavity is filled uniformly. After a short time the binder effects a permanent adhesion of the granules into a cohesive mass fixed in the cavity, thereby preventing the outflow of granules from wall apertures, for example, vents. Suitable granular materials are vermiculite, perlite, and hard foam particles, 1–10 mm in size. Hard foam granules or particles comprising smooth, spherical beads of expanded polystyrene having a bulk density of 12 to 20 $kg/m^3$ prior to cavity filling are particularly suitable. The binder is, for example, a liquid adhesive which under cavity filling conditions changes from a readily flowing substance into a highly adhesive one in about one hour, for instance by evaporation of diluent. A suitable adhesive is an emulsion of a latex in water. By evaporation of water a smooth water-repellent layer forms on the granules, which permanently binds the granules together. A synthetic polymeric latex such as a vinyl acetate copolymer latex has been found to be particularly suitable.

In addition to filling wall cavities in buildings, this technique can also be used for the introduction of insulating material into the cavities of any double-walled systems, such as storage vessels, tanks and the like of large dimensions; and it can also be used in the construction of heat insulating building elements, such as blocks and panels.

When thermally insulating buildings the mixture is introduced through small holes drilled in the outer wall, most of which will require ladder access. The filler gun used must therefore be easy to handle; and moreover it should be readily controllable so that cavity filling can process smoothly and evenly, and any interruption due to cavity obstacles or the need to move from one hole to the next can be dealt with without detriment to the installation. Also, the filler gun should be such that it is not easily blocked by the sticky mass formed within it, and, if such blockage does occur, is easily cleaned and unblocked.

In published Netherlands Patent Application No. 7709666 and the corresponding UK Patent Specification No. 1,600,096, there is described a filler gun for injecting a mixture of a granular or particulate solid and a liquid binder into a cavity of a doublewalled system. The filler gun comprises a hollow body having an outlet at one end, a binder inlet for liquid binder at the other end, and a side inlet for granular or particulate solid, which said inlet is directed towards the outlet at an angle of less than 90° with respect to the direction of flow of liquid binder from the binder inlet to the outlet in operation of the gun.

It is an object of the invention to provide a filler gun which in the event of a blockage therein may readily be cleaned or unblocked.

According to the present invention there is provided a filler gun suitable for injecting a mixture of a granular or particulate solid and a liquid binder into a cavity, which comprises a hollow body having an outlet at one end, a binder inlet for liquid binder at the other end, and a side inlet for granular or particulate solid, which side inlet is directed towards the outlet at an angle of less than 90° with respect to the direction of flow of liquid binder from the binder inlet to the outlet in operation of the gun, wherein an outlet sleeve is releasably located in the body between the side inlet and the said one end, and an inlet sleeve is releasably located in the body between the side inlet and the said other end, the inlet sleeve having an axial bore and a side passage opening into the bore which passage is adapted for attachment of a liquid binder supply line, and the body is slotted to enable withdrawal of the inlet sleeve therefrom without prior detachment of an attached binder supply line.

Preferably, the outlet and inlet sleeves are releasably located in a substantially cylindrical bore extending from the said one end to the said other end of the body. The outlet sleeve preferably has a substantially cylindrical outlet passage and an inner portion providing a forwardly converging throat between the side inlet and the outlet passage. Advantageously a plurality of forwardly inclined ports extends to the outlet passage from an annular groove around the outlet sleeve forming with the body an air supply manifold, the body being apertured for supply of air under pressure to the manifold. Preferably the outlet sleeve is adapted for releasable attachment thereto of a nozzle pipe.

A preferred embodiment of the present invention will now be described by way of example, with reference to the accompanying illustrative drawing, which is a part sectional side elevation of a filler gun in accordance with the invention.

The filler gun comprises a hollow body 1 having an outlet at one end 4, a binder inlet for liquid binder at the other end 15, and a cylindrical side-arm 2 providing a side inlet for the supply of granular or particulate solid to the adjacent part of the interior of the body 1 which constitutes a mixing chamber 3. The hollow interior of the body 1 comprises a cylindrical bore extending from the outlet end 4 to the other end 15. The side-arm 2 has its axis at about 45° to the axis of the body 1, and it is directed towards the outlet end 4 of the body 1 so that granular solid entering the chamber 3 therethrough will be flowing towards the outlet end 4 at about 45° with respect to the direction of of flow from the binder inlet to the outlet in operation of the gun. Releasably located within the body 1, between the chamber 3 and the outlet end 4, is an outlet sleeve or liner 5, which is bored to provide a cylindrical outlet passage 6 and an inner portion providing a forwardly converging throat 7, which constitutes a venturi for material moving from the chamber 3 to the outlet passage 6. Around the outlet sleeve 5 is an annular groove 8 forming, with the body 1, an air supply manifold, a plurality, for example eight, forwardly inclined ports in the form of drillings 9 extending from the groove 8 to the outlet passage 6. The outlet sleeve 5 is held sealingly in place by a union ring 10, which itself is retained by an annular flange 11 welded or adhesively attached to a nozzle pipe 12 the inner end 13 of which screws into a threaded end portion 14 of the outlet sleeve 5. Seals are provided to maintain fluid-tightness; and the nozzle pipe 12 may be inserted through holes drilled in the mortar joints of a wall for cavity access. Releasably located within the body 1, between the chamber 3 and the other end 15, is a cylindrical inlet sleeve or liner 16 having an axial bore 17 internally screw threaded at 18 for the reception of a small-bore injection orifice (not shown) and threaded at 19 for the reception of an end plug 20 blanking off the bore 17 at the rear end. The inlet sleeve 16 is itself retained in place by a union ring 21. A side passage opening into the bore 17 is provided in the form of a threaded hole 23 in the sleeve 16. The hole 23 is provided for screw attachment of a union at one end of a valve-controlled liquid binder supply line (not shown), and a slot 22 in the body 1 enables the sleeve 16 to be withdrawn from the body 1 without prior detachment of an attached supply line. At the outlet end 4 of the body 1 are two diametrically opposed unions 24, 25 for the respective attachment of an air supply line and a pressure gauge (neither shown). Attached to the outer end of the side-arm 2 is a tapered hose spigot 26, the spigot 26 being secured to the side-arm 2 by a union ring 27.

The filler gun illustrated in the accompanying drawing has a number of design features which relate to its intended use for dispensing coated granular solids, in particular smooth, spherical foamed polystyrene beads, making it particularly useful. For example, the union rings 10, 21 and 27 have knurled peripheries and the flange 11 and the plug 20 have spanner flats to facilitate dismantling of the gun. The outlet sleeve 5 and inlet sleeve 16 are an easy sliding fit in the body 1, air-and liquid-tightness being achieved by readily renewable O-rings, and can be quickly withdrawn for cleaning, the slot 22 in the body enabling the sleeve 16 to be withdrawn without disconnection of an attached liquid binder supply line. Since the nozzle pipe 12 is a separate unit, it can be changed. within a limited size range, to suit conditions at the site where cavity filling is to be carried out.

In use the filler gun is supplied with granular solid through a relatively large diameter flexible tube connected to the spigot 26, the granules being transported from a bulk supply, for example, a tanker with the aid of a transport gas, usually air. The gun is also supplied with liquid binder, under pressure, through a valve-controlled small bore tube connected to a spigot (not shown) screwed into the hole 23. Compressed air at, for example, 6–7 bar pressure is supplied via a line (not shown) attached to the union 25 and is distributed via the manifold 8, issuing as air jets into the outlet passage 6 in the direction of the nozzle pipe 12 from the drillings 9. Mixing of the binder and the granules takes place in the chamber 3, and the resulting mixture is drawn forward through the throat 7 by the air jets from the drillings 9, and leaves through the nozzle pipe 12. The granule and binder streams to the mixing chamber are set manually, independently of each other. Occasionally unforeseen circumstances cause outflow through the nozzle pipe 12 to stop during filling of a wall cavity. This can be due, for instance, to the presence in the cavity of unknown obstacles, for example, obstacles left during construction. When the nozzle outflow stops, supply of the granular solid soon ceases, but the supply of binder goes on so long as it is not shut off. The mixing chamber rapidly fills with binder. To avoid binder getting into the supply line for the granular solid the gun is operated with the granular solid supply line uppermost so that with the backwardly curving loop formed therein when the gun is so positioned provides a surge space in which excess binder can be collected pending operator shut off of the supply of binder. To facilitate such operation and in order to ensure that there is a sufficiently smooth flow of the granular solid, the angle the axis of the side-arm 2 (i.e. the side inlet for the supply of granular solid) makes with the axis of the body of the gun is preferably 30°–50°.

When cavity filling with light particles such as smooth, spherical foamed polystyrene beads the transport gas is air.

When the gun is working, air at, for example, 4–6 bar may be used to pressurize the binder supply vessel. The supply of liquid binder to the mixing chamber 3 from the bore 17 in the inlet sleeve 16 is advantageously through an atomizing head attached via the screw thread at 18. A suitable atomizer is of the kind used for atomizing oil in furnaces. This way of introducing the binder has the considerable advantage over customary siphon atomization in a filler gun that during atomization there is little or no drop in temperature. With siphon atomization a 10°–14° C. drop can be caused by evaporation of water, and the latex emulsion becomes too cold then for it to spread out sufficiently to form an adequate film round the granules. When atomized under pressure the binder is substantially at ambient temperature when it meets the granular solid.

The liquid binder used is preferably one having a minimum film forming temperature not greater than 0° C. and is preferably a copolymer of vinylacetate and ethylene, advantageously a copolymer containing by weight at least 12% by weight of ethylene. For wall cavity filling the amount of binder is conveniently such as to provide 5 to 10% preferably 6 to 8% by weight of binder solids based on the weight of granular or particulate solid. The solids content of the binder itself may be 10 to 20% by weight, while the total weight ratio of granular or particulate solid to binder will generally be in the range 10:1 to 10:10.

After a cavity has been filled, the mixture of granular or particulate soild and liquid binder is allowed to dry and set. The setting time depends on a number of factors, such as environmental temperature and relative humidity, free passage of air, and composition and quantity of binder used.

A particularly suitable liquid binder is a vinylacetate-/ethylene copolymer sold by Vinyl Products Ltd. under the trade mark "Vinamul 3252". This copolymer has a minimum film forming temperature of 0° C., an ethylene content of 12% by weight, a non-volatiles content of 54 to 56% by weight and a pH of 4.5 to 5.0.

I claim:

1. A filler gun suitable for injecting a mixture of a granular or particulate solid and a liquid binder into a cavity, which comprises a hollow body having an outlet at one end, a binder inlet for liquid binder at the other end, and a side inlet for granular or particulate solid, which side inlet is directed towards the outlet at an angle of less than 90° with respect to the direction of flow of liquid binder from the binder inlet to the outlet in operation of the gun, characterized in that an outlet sleeve is releasably located in the body between the side inlet and the said one end, and an inlet sleeve is releasably located in the body between the side inlet and the said other end, the inlet sleeve having an axial bore and a side passage opening into the bore which passage is adapted for attachment of a liquid binder supply line, and the body is slotted to enable withdrawal of the inlet sleeve therefrom without prior detachment of an attached binder supply line.

2. A filler gun as claimed in claim 1 further characterized in that the outlet and inlet sleeves are releasably located in a substantially cylindrical bore extending from the said one end to the said other end of the body.

3. A filler gun as claimed in any of claims 1 or 2 further characterized in that the outlet sleeve is adapted for releasable attachment thereto of a nozzle pipe.

4. A filler gun as claimed in claim 1 or 2 further characterized in that the outlet sleeve has a substantially cylindrical outlet passage and an inner portion providing a forwardly converging throat between the side inlet and the outlet passage.

5. A filler gun as claimed in claim 4 further characterized in that the outlet sleeve is adapted for releasable attachment thereof of a nozzle pipe.

6. A filler gun as claimed in claim 4 further characterized in that a plurality of forwardly inclined ports extends to the outlet passage from an annular groove around the outlet sleeve forming with the body an air supply manifold, the body being apertured for supply of air under pressure to the the manifold.

7. A filler gun as claimed in claim 6 further characterized in that the outlet sleeve is adapted for releasable attachment thereto of a nozzle pipe.

* * * * *